United States Patent [19]

Wells et al.

[11] Patent Number: 4,628,875

[45] Date of Patent: Dec. 16, 1986

[54] LUBRICANT SUPPLY RAIL

[75] Inventors: Larry Wells; Karl Graham, both of Columbus, Ind.

[73] Assignee: Cummins Engine Company, Inc., Columbus, Ind.

[21] Appl. No.: 749,754

[22] Filed: Jun. 28, 1985

[51] Int. Cl.[4] ..... F01M 9/10

[52] U.S. Cl. ..... 123/90.36; 123/90.33

[58] Field of Search ..... 123/90.33, 90.36

[56] References Cited

U.S. PATENT DOCUMENTS

| | | | |
|---|---|---|---|
| 1,363,500 | 12/1920 | Duesenberg | 123/90.33 |
| 1,393,913 | 10/1921 | Short | 123/90.36 |
| 1,438,163 | 12/1922 | Montgomery | 123/90.33 |
| 1,491,710 | 4/1924 | Layman | 123/90.33 |
| 1,784,767 | 12/1930 | Summers | 123/90.36 |
| 2,104,729 | 1/1938 | Bijur | 123/90.33 |
| 2,224,376 | 12/1940 | Chayne et al. | 123/90.36 |
| 3,008,544 | 11/1961 | Krizman | 123/90.36 |

FOREIGN PATENT DOCUMENTS

| | | | |
|---|---|---|---|
| 223393 | 10/1924 | United Kingdom | 123/90.36 |

*Primary Examiner*—Ira S. Lazarus

*Attorney, Agent, or Firm*—Sixbey, Friedman & Leedom

[57] ABSTRACT

A lubricant supply rail is provided for an internal combustion engine to provide an adequate supply of lubricant from the engine lubrication circuit to the bearing surfaces of the rocker arms, the valves and the push rods. The lubricant supply rail of the present invention is configured to provide automatic fluid communication between the cylinder head lubricant outlet port and the lubrication channels contained within the rocker arm support assembly and includes a lubricant supply inlet which communicates directly with the cylinder head and a plurality of transfer bores spaced to communicate directly with each rocker arm support assembly. The lubricant supply rail is preferably formed of nylon or like material and includes a conduit portion sealed at each end by end caps having a configuration which permits effective sealing of the conduit by ultrasonic welding techniques. The conduit portion of the lubricant supply rail has a cross-sectional configuration which permits the rail to be held in sealing engagement with the rocker arm pedestal base. Installation of the lubricant supply rail is accomplished quickly and easily during engine assembly.

18 Claims, 5 Drawing Figures

LUBRICANT SUPPLY RAIL

TECHNICAL FIELD

The present invention relates generally to lubrication systems for internal combustion engines and specifically to apparatus for supplying lubricant to the rocker arm assemblies of an internal combustion engine.

BACKGROUND ART

Providing an adequate supply of lubricant from the lubrication system of an internal combustion engine to the valves and the bearing surfaces of the rocker arm assemblies has long been a concern of engine manufacturers. It is vitally important that the bearing surfaces be properly lubricated. Unless the proper amount of lubricant is supplied to the rocker arm bearing surfaces, the valve stems and the push rod, these parts will not be able to maintain the constant motion required of them during engine operation, but will tend to stick and, ultimately, could become frozen and immovable. If the rocker arm bearing surface does not receive adequate lubrication, the bearing surfaces rapidly overheat, thereby totally sealing out any lubricant available for these bearing surfaces and rapidly destroying them through heat, friction and galling action.

Conversely, if too much lubricant is supplied to the rocker arms, valves and push rods, an excess load will be placed on the lubricant pump and lead to an unnecessary parasitic load on the engine with concommitant loss in engine efficiency. Since lubricant is generally supplied to the rocker arms under pressure, an excessive amount of lubricant could accumulate in the vicinity of the engine head.

An ideal rocker assembly lubricant supply line is one that is simple in configuration, has only a minimum number of parts, is easy to install during engine assembly and provides an automatic fluid connection between the rocker assemblies and the engine lubrication fluid circuit. An ideal lubricant supply line will also be inexpensive to manufacture and easy to replace.

The prior art has proposed various solutions for addressing the problem of providing and maintaining an adequate flow of lubricant to the rocker arm bearing surfaces, valve stems and push rods. Some type of fluid connection between the engine lubrication circuit and each rocker assembly with its associated valves and push rods must be provided to convey lubricant from the lubrication circuit to the rocker assemblies. U.S. Pat. No. 2,641,235 to Slonneger is exemplary of the prior art which provides a direct fluid connection between the crankcase and each rocker assembly by a series of conduits contained within the block and the head. Lubricant is supplied directly to the base of the rocker arm support by a duct in the head. This arrangement, however, requires a multiplicity of lubricant supply lines and ducts for each rocker assembly, all of which have to be installed separately during engine assembly. Moreover, the appropriate ducts have to be formed during casting or subsequently bored in the engine head in specific locations for each rocker assembly, causing substantial manufacturing expense.

Another solution to the rocker assembly lubrication supply problem directs lubricant directly to the shaft on which the rocker arms are journaled as disclosed in U.S. Pat. No. 1,363,500 by Duesenberg et al. Lubricant can then be directly communicated to the bearing surfaces from the crankcase. The arrangement taught by Duesenberg et al, however, requires an exteriorly located lubricant supply pipe from the sump to the rocker assembly bearing shaft which includes bores to correspond with each rocker assembly. While the installation of this type of lubrication supply line has fewer components to manufacture and assemble than the type of lubricant supply system described by Slonneger, the connection of the exterior supply line represents a separate installation step from the assembly of the rocker arm support.

Lubrication of the valve stems has also been achieved by providing lubricant supply lines positioned above the valves and supported by the rocker cover. U.S. Pat. No. 1,438,163 to Montgomery discloses a forced feed oiler which extends along a longitudinal axis inside the rocker cover and includes a plurality of depending tubes extending downwardly toward the rocker assembly. The tubes terminate in wicks which are held in operative relationship with the parts to be lubricated. A similar wick-type rocker arm lubricator is disclosed in U.S. Pat. No. 1,491,710 to Layman, except that the lubricant supply lines are located outside the rocker cover. This lubricator also employs a number of downwardly directed pipes and wicks to convey lubricant to the rocker arms and bearings. A similar arrangement is additionally taught by Bijur in U.S. Pat. No. 2,104,729. In this patent, lubrication is supplied to the rocker assemblies by a multi-part circuit which is mounted completely exteriorly to the rocker cover and provides a direct connection to meter lubricant to each pair of rocker arms and associated structures. While all of the lubricant supply systems described in the aforementioned references may effectively supply lubricant to the rocker arms and associated structures, the number of component parts of each of these systems make such systems expensive to manufacture, difficult to assemble and install quickly during engine assembly and prone to leaking and other problems after installation.

Consequently, the prior art has failed to disclose a simple, inexpensive lubricant supply system which may be quickly and easily installed during engine assembly to provide automatic controlled fluid communication between the engine lubrication circuit and a plurality of rocker arm assemblies and which may be quickly and easily replaced, if required, during engine maintenance.

SUMMARY OF THE INVENTION

It is a primary object of the present invention, therefore, to provide a simple, inexpensive lubricant supply system which may be quickly and easily installed during engine assembly to provide automatic, controlled fuid communication between the engine lubrication circuit and a plurality of rocker arm assemblies to convey lubricant to the bearing surfaces of the rocker arm assemblies and to the valves and push rods.

It is another object of the present invention to provide a lubricant supply system for transferring lubricant from the lubricant supply of an internal combustion engine to lubrication channels associated with a plurality of rocker arm supports adapted to be mounted at spaced mounting locations on the engine cylinder head which includes conduit means containing at least one lubricant inlet port for receiving lubricant from the engine lubrication supply and a plurality of lubricant transfer bores, at least one of the bores being adjacent the inlet port, to provide direct fluid communication between the engine lubricant supply and the rocker arm lubrication channels when the conduit means is operably associated with the engine cylinder head.

It is yet another object of the present invention to provide a lubricant supply system for transferring lubricant from the lubricant supply of an internal combustion engine to lubrication channels associated with a plurality of rocker arm supports adapted to be mounted at spaced locations on the engine cylinder head which includes a single integral pipe containing at least one lubricant inlet port for receiving lubricant from the engine lubricant supply, a plurality of lubricant transfer bores, spaced to correspond to the locations of the rocker arm supports, and rocker support engaging means which engages the rocker arm supports to form a sealed fluid connection between the interior of the pipe and the lubrication channels of each corresponding rocker arm support through the transfer bores.

It is still another object of the present invention to provide a lubricant supply pipe having a simple, unitary construction which facilitates installation and replacement and which is durable enough to withstand engine operating conditions, but inexpensive to manufacture.

It is a further object of the present invention to provide a lubricant supply pipe having a cross-sectional configuration which establishes automatic fluid sealing engagement between the pipe and the engine lubricant supply and between the pipe and the interior lubrication transfer system of a plurality of rocker assemblies upon installation of the pipe on the engine.

It is a still further object of the present invention to provide a lubricant supply rail having an arcuate hood portion formed integrally with a flat bottom portion, wherein the arcuate hood portion includes rocker support engaging means which forms a sealed fluid connection between the interior of the rail and the interior lubrication channels of a rocker arm support.

It is a still further object of the present invention to provide a lubricant supply pipe which provides automatic fluid communication between the engine head lubrication circuit and a plurality of rocker arm assemblies positioned at spaced locations along the longitudinal axis of the engine when the pipe is operably installed on the engine.

It is yet a further object of the present invention to provide a lubricant supply pipe including fluid impermeable end caps having a configuration which permits quick installation and which effectively seals the pipe against leakage when the pipe is employed to convey lubricant under pressure to a plurality of rocker arm assemblies positioned along the longitudinal axis of the engine.

In accordance with the aforesaid objects, a lubricant supply system is provided for transferring lubricant from the lubricant supply of an internal combustion engine to lubrication channels associated with a plurality of rocker arm supports adapted to be mounted at spaced mounting locations on the engine cylinder head which includes conduit means containing at least one lubricant inlet port for receiving lubricant from the engine lubricant supply and a plurality of lubricant transfer bores, at least one bore being located adjacent to the inlet port, which provide direct fluid communication between the engine lubricant supply and the rocker arm lubrication channels when the conduit means is operably associated with the engine cylinder head. The conduit means includes a single integral pipe which contains the inlet port and transfer bores and which is formed to extend adjacent to the spaced rocker arm mounting locations when the conduit means is operably associated with the cylinder head. The pipe further includes rocker support engaging means which engage the rocker arm supports when the pipe is in operative position to form a sealed fluid connection between the interior of the pipe and the associated rocker arm lubrication channels through the lubricant transfer bores. The supply pipe is open at opposed ends and is formed of a single unitary length of a rigid durable material, and the lubricant inlet port and one of the transfer bores are located adjacent one another along the longitudinal length of the pipe. The supply pipe additionally includes an arcuate hood portion integrally connected to a flat bottom portion, the hood including a rocker support engaging means to provide a sealed fluidic connection between the interior of the pipe and the rocker arm support lubrication circuit. The flat bottom portion permits the pipe and the rocker support assembly to be mounted on a flat rocker support mount and sealing surface on the engine cylinder head. The conduit means also includes a pair of cap means sealed to the open ends of the pipes to provide a fluid impermeable seal at opposed ends of the pipe.

The cross-sectional configuration of the conduit means is designed to permit the conduit means to be held in fluid sealing engagement with the lubrication channels of each rocker arm assembly while simultaneously achieving automatic fluid communication between the engine lubrication circuit and the rocker arm pedestal lubrication circuit when the conduit means is operably positioned on the engine.

Other objects and advantages of the present invention will be apparent following an examination of the following description and drawings and the appended claims.

BEST MODE FOR CARRYING OUT THE INVENTION

The present invention relates to a lubricant supply pipe or rail for transferring lubricant from the lubricant supply of an internal combustion engine to the internal lubrication circuit of a plurality of rocker arm support assemblies located at approximately equidistant intervals along the longitudinal axis of the engine head. The structure of the rocker arm assemblies with which the present lubricant supply pipe or rail must sealingly engage to provide a proper supply of lubricant under pressure is described in copending application entitled ROCKER ARM SUPPORT ASSEMBLY, Ser. No. 749,753, filed on June 28, 1985, the same day as the present application, naming Larry Wells and James D. Baugh as inventors and assigned to the same assignee as the present invention, the disclosure of which is hereby incorporated by reference.

Figure 1:
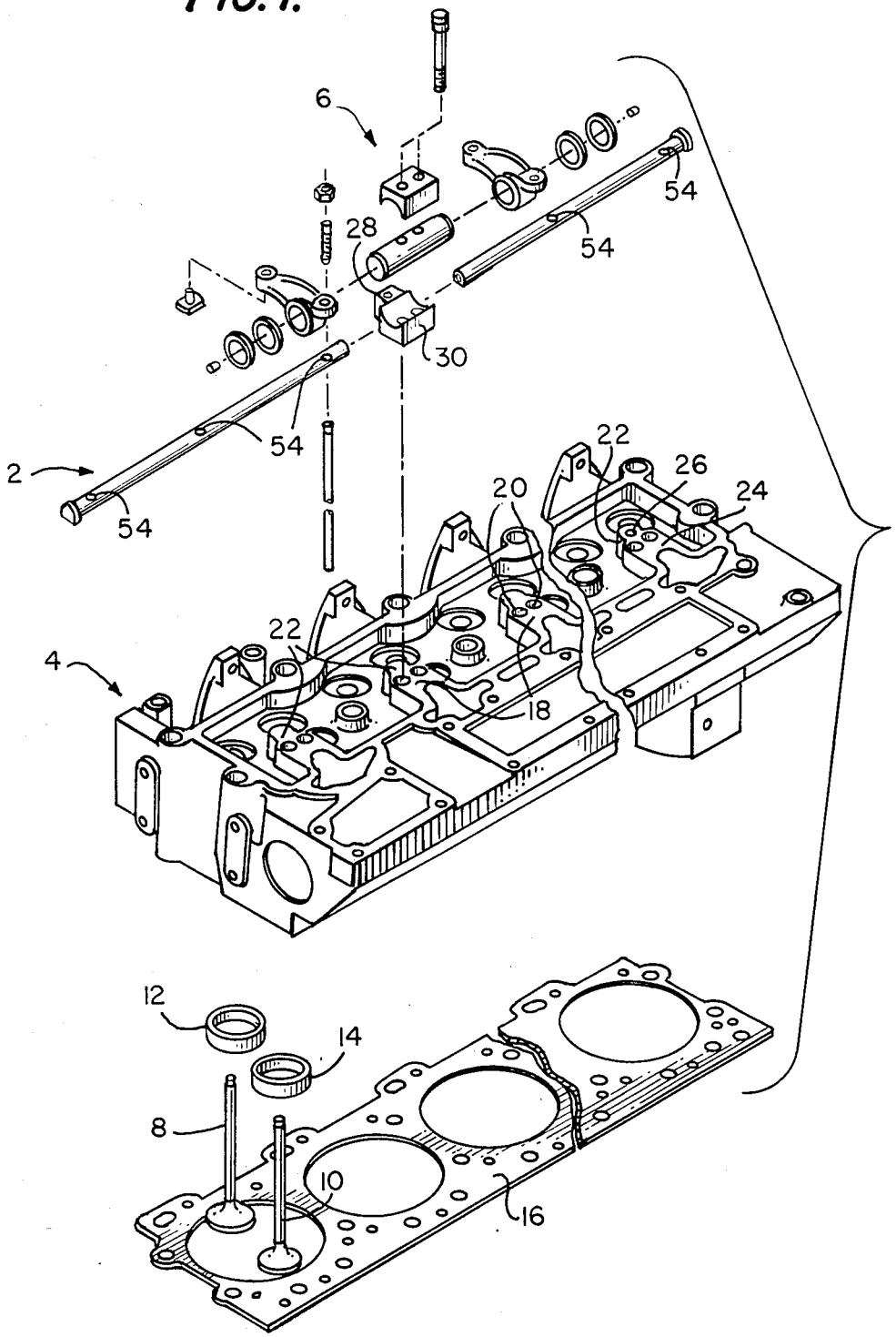
FIG. 1 is an exploded perspective view of the head of an internal combustion engine, showing the lubricant supply pipe of the present invention and its location relative to the engine head, the rocker arm assemblies and valves.

FIG. 1 illustrates, in an exploded perspective view, the lubricant supply pipe or rail 2 of the present invention and its location relative to the engine head 4 and a single rocker arm assembly 6. Intake valve 8 and exhaust valve 10 and their associated valve seats, referred to as 12 and 14, respectively, are shown adjacent the cylinder head gasket 16. The cylinder head 4 includes on the upper surface a plurality of rocker arm pedestal mounts 18 integrally formed in the head. Each pedestal mount 18 has a flat upper surface and includes a pair of threaded apertures 20. Each rocker arm pedestal mount also includes a nose portion 22 which functions as a support for the lubricant supply pipe 2 in a manner which will be explained in more detail hereinbelow.

The provision of rocker arm pedestal mounts which are charaterized by a flat planar surface located parallel to the longitudinal axis of the engine for engaging the rocker arm pedestals allows these structures to be machined easily during formation of the engine cylinder head, thus reducing manufacturing costs associated with prior art rocker arm mounting structures. The nose portion 22 of an end rocker pedestal mount 24 includes an outlet port 26 for the portion of the engine lubrication circuit contained within the cylinder head (not shown).

The lubricant supply pipe 2 is configured to be inserted through an extension 28 of the rocker arm support pedestal 30 so that when the support pedestal is secured to the rocker pedestal mount 18 as described in detail in the copending application entitled ROCKER ARM SUPPORT ASSEMBLY, Ser. No. 749,753, the lubricant supply pipe is held in sealing fluid engagement therewith.

Figure 2:
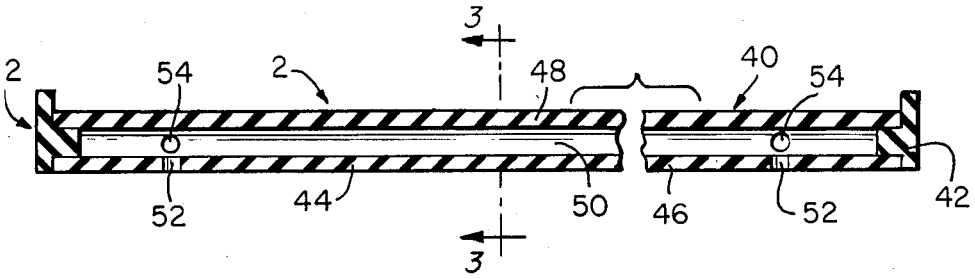
FIG. 2 is a cross-sectional view taken along the longitudinal axis of the present lubricant supply pipe.
Figure 3:
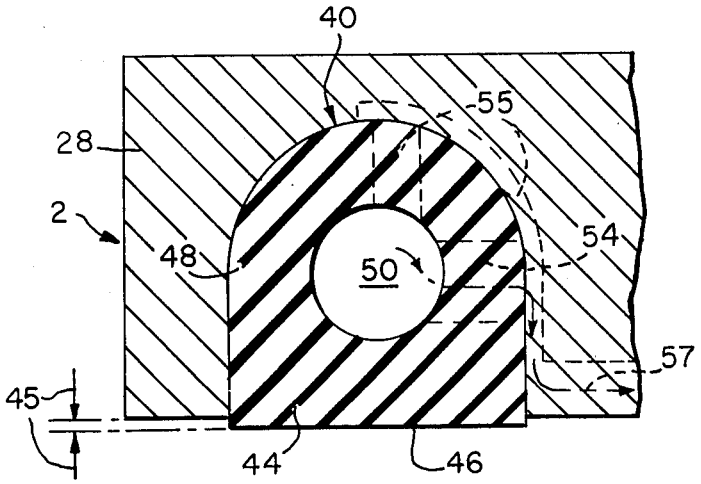
FIG. 3 is a cross-sectional view taken along lines 3—3 of FIG. 2.

FIGS. 2 and 3 illustrate the cross-sectional configurations of the lubricant supply pipe 2 in the longitudinal direction and perpendicular to the longitudinal, respectively. The lubricant supply pipe 2 includes a conduit portion 40 and end caps 42. The conduit portion 40 includes a bottom wall section 44 with a flat outer surface 46. An arcuate hood section 48 is integrally connected to the bottom wall section 44 to form top and side walls enclosing a lubricant passage 50. The cross-sectional configuration shown in FIG. 3 and formed by the integral connection of the arcuate hood section 46 and flat bottom wall section 44 conforms to that of the extension 28 of the rocker arm support pedestal which is designed to secure pipe 2 in fluid alignment with each rocker arm pedestal lubrication circuit. Since the bottom surfaces of both the pedestal 30 and the supply pipe 2 together form a substantially smooth flat planar surface, engagement with the planar pedestal mount 18 on the cylinder head is facilitated. Moreover, the same flat surface on the head can form both the rocker arm pedestal mount and the lubricant supply pipe engaging and sealing surface, thereby further reducing engine head machining costs.

The transverse distance between the top of the arcuate hood 48 and the bottom wall 46 for the conduit portion 40 of the supply pipe is selected so that it is greater than that of extension 28 by the distance between arrows 45 in FIG. 3. This causes the conduit portion bottom wall to be compressed against the nose portion 22 of the cylinder head pedestal mount 24 when the rocker arm support assembly is biased against the head. The compression of the bottom wall around inlet port 52 automatically creates a fluid tight seal when the lubricant supply rail and rocker arm support assembly are secured to the head. An effective seal is thus formed without the need for forming the conduit portion to correspond exactly to the height of extension 28.

The cross-sectional configuration of conduit 40 facilitates both lubricant transfer to each rocker pedestal and the sealing engagement of the lubricant supply pipe 2 with all of the rocker pedestals. To this end, a lubricant inlet port 52 is positioned toward each end cap 42 in the conduit bottom wall section 44. The exact location of the inlet ports 52 is determined to cause automatic alignment between the cylinder head lubricant outlet port 26 and one of the ports 52 when the lubricant supply tube is engaged by the extensions 28 of the rocker arm support pedestal 30 associated with the pedestal mount 24 containing port 26. Since an inlet port 52 is located the same distance from each end of the pipe 2, a proper fluid connection is formed with port 52 regardless of which end of pipe 2 is mounted adjacent port 26. The inlet port 52 at the opposite end of the engine is merely sealed against the corresponding pedestal mount 18 by the associated pedestal.

The simple engagement of the lubricant supply tube of this invention with the pedestal extensions which occurs during engine assembly represents a significant savings in assembly time over what is required for many prior art lubricant supply systems. Since such prior art systems are typically multi-part devices which themselves require assembly prior to assembly on the engine, the savings in assembly time achieved by the present invention can be substantial. Furthermore, the disclosed system eliminates virtually all of the expensive casting and machining operations required for those prior art lubrication systems having internally formed supply conduits. Moreover, the provision of an inlet port at each end of the conduit 40 allows the assembly line worker to install the tube from either end. One inlet port 52 will automatically align with the head outlet 26, and the other end will be sealed by the flat surface of the projection 26 at the opposite end of the head.

The arcuate bond portion 48 of the conduit is provided with a plurality of evenly spaced lubricant transfer bores 54 which are positioned to communicate with internal lubrication channels in the rocker arm support pedestal extension 28. One such channel 55 is shown in FIG. 3. Lubricant is directed from lubricant passage 50 through transfer bore 54 and into channel 55 along the path shown by arrows 57. Channel 55 further provides fluid communication downstream of arrows 57 with lubricant flow passages (not shown) integrally formed in the interior of the rocker arm support pedestal 30. Lubricant is from there directed into the interior of the support pedestal, to the shaft and from there to the rocker arms and push rods in a manner which is shown and described in detail in the copending application entitled ROCKER ARM SUPPORT ASSEMBLY, Ser. No. 749,753. One transfer bore 54 is provided to correspond with each rocker arm assembly 6. The transfer bores 54 are further positioned to align with the pedestal extension lubrication channels 55 of each associated rocker arm assembly when the conduit 40 is inserted into the extensions from either end of the head during assembly and to provide direct fluid communication between the engine lubricant supply circuit and the interior lubrication circuit of each associated rocker arm assembly when the lubricant supply rail is operably installed on the engine cylinder head.

The lubricant supply tube may be constructed of any suitable inert, durable material which will withstand the temperature and other operating conditions commonly encountered in the engine environment. Nylon has been found to be a particularly suitable material. However, any similar material, such as, for example, one of the many suitable plastics or even metal, could be used with substantially similar results.

The end caps 42 are preferably formed from the same or a similar compatible material as the conduit 40. The preferred method of attachment for the end caps 42 is by ultrasonic welding. These techniques are well known to those skilled in the art. To provide an effective sealing member for the conduit portion 40 of the lubricant supply tube 2 which can be ultrasonically welded to seal the end of the conduit, an end cap or sealing member 42 having the configuration shown in FIGS. 4*a* and 4*b* has been found to be effective. Other end cap configurations which serve the same function could be employed as well.

Figure 4A:
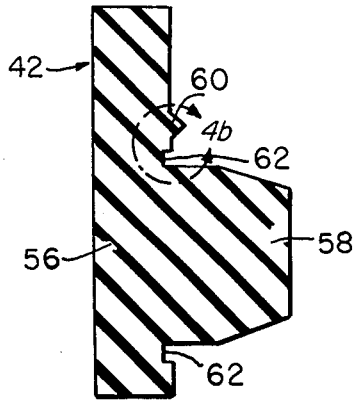
FIG. 4*a* is a cross-sectional view of an end cap for sealing the present lubricant supply pipe.
Figure 4B:
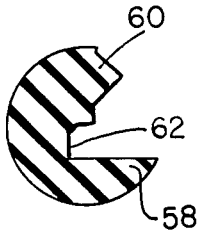
FIG. 4*b* is an enlarged view of the circled portion of FIG. 4*a*.

Referring to FIGS. 4*a* to 4*b*, each end cap includes an end wall portion 56 and a sealing protrusion 58. To ensure effective ultrasonic welding of the end cap, at least one welding projection 60 is provided. An annular groove 62, which is shown enlarged in FIG. 4*b*, is provided at the junction between end wall portion 56 and sealing protrusion 58. This functions to seat the end of conduit 40 and aids in positioning end cap 42 correctly on the conduit end prior to welding. The exact configuration of the annular groove 62 will conform to the cross-sectional configuration of the conduit 40 shown in FIG. 3. The configuration of sealing protrusion 58 shown in FIG. 4*a* has been found to produce enhanced sealing following the ultrasonic welding of the end caps on the ends of conduit 40.

Because the lubricant in conduit 40 is under relatively high pressure during engine operation, the means used to seal the conduit ends must be able to withstand the pressures reached without leaking for sustained periods of time. Ultrasonic welding is the preferred method of sealing, particularly when the lubrication supply tube is made of nylon. However, the actal method employed will depend in large measure on the material chosen for the conduit and end caps.

INDUSTRIAL APPLICABILITY

The present lubricant supply rail will find its primary application to supply lubricant from the lubrication circuit on an internal combustion engine to the bearing surfaces of the rocker arms, the valves and the push rods. It may be easily installed during engine assembly to provide automatic fluid communication between the cylinder head lubricant outlet port and the interior lubricant channels of the rocker arm support assembly. The precise location of equally spaced lubricant transfer bores in the conduit portion of the lubricant supply rail relative to the positions of two lubricant inlet ports allows the supply rail or pipe to be correctly installed with either end over the cylinder head lubricant outlet. If required, the lubricant supply rail of the present invention may also be replaced quickly and easily.

We claim:

1. A lubricant supply rail for transferring lubricant from an internal combustion engine lubricant supply to a plurality of lubrication channels, each internally contained within one of a plurality of rocker arm support pedestals adapted to be mounted at spaced mounting locations on the engine cylinder head and including extension means for engaging the lubricant supply rail, said supply rail including conduit means for providing a direct fluid connection between a cylinder head lubricant outlet port and each of said rocker arm support pedestals when said conduit means is operatively positioned adjacent to both the cylinder head spaced mounting locations and the rocker arm support pedestal extension means, said conduit means including at least one lubricant inlet port and a plurality of spaced lubricant transfer bores, wherein said inlet port automatically aligns with said cylinder head outlet port and each of said transfer bores automatically aligns with one of said support pedestal lubrication channels when said conduit means is operatively positioned adjacent to both the cylinder head spaced mounting locations and the rocker arm support pedestal extension means to form a direct fluid connection for the flow of lubricant from the engine cylinder head outlet port through said conduit means to each of said rocker arm support pedestals.

2. A lubricant supply rail as defined in claim 1, wherein said conduit means is formed from nylon.

3. A lubricant supply rail as defined in claim 1, wherein said conduit means is formed from metal.

4. A lubricant supply rail as defined in claim 1, wherein said conduit means further includes rocker arm support pedestal engaging means for engaging the extension means on each of said rocker arm support pedestals when said conduit means is operatively positioned adjacent the cylinder head and support pedestals to form a sealed fluid connection between the interior of the conduit means and the lubrication channel of each support pedestal through said lubricant transfer bores.

5. A lubricant supply rail as defined in claim 4, wherein said conduit means includes a single integral pipe formed to extend longitudinally along substantially the entire length of the engine cylinder head.

6. A lubricant supply rail as defined in claim 5, wherein said pipe is open ended and said conduit means includes a pair of cap means sealed to the open ends of said pipe for providing a fluid impermeable seal at opposed ends of said pipe.

7. The lubricant supply rail described in claim 6, wherein each said end cap means includes sealing protrusion means for insertion into the opposed ends of said conduit means.

8. The lubricant supply rail described in claim 7, wherein each said cap means is secured to each end of said conduit means by ultrasonic welds.

9. The lubricant supply rail described in claim 8, wherein said ultrasonic welds are formed by providing said end cap means with a rib positioned annularly around said sealing protrusion means for defining the point of contact between said end cap means and the ends of said pipe when the ultrasonic welding commences.

10. The lubricant supply rail described in claim 6, wherein said pipe includes a bottom wall portion having a flat exterior surface and an arcuate hood portion connected to said bottom wall portion, said arcuate hood portion forming said rocker arm support pedestal engaging means.

11. The lubricant supply rail described in claim 10, wherein said lubricant inlet port is located in said pipe bottom wall portion.

12. The lubricant supply rail described in claim 11, wherein said lubricant transfer bores are located in said pipe arcuate hood portion.

13. A lubricant supply rail as defined in claim 11, wherein said pipe bottom wall portion includes a pair of lubricant inlet ports, each of said inlet ports being spaced inwardly from the ends of said pipe a distance which provides automatic fluid alignment with the cylinder head outlet port when either end of the pipe is operatively positioned adjacent to the outlet port.

14. A lubricant supply rail as defined in claim 12, wherein said lubricant transfer bores are positioned adjacent one another at spaced locations along said arcuate hood portion, wherein the distance between adjacent lubricant transfer bores is substantially equal to the distance between the lubrication channels in adjacent rocker arm support pedestal extension means to provide automatic fluid alignment between said transfer bores and said lubrication channels when said pipe is operatively engaged by said support pedestal extension means.

15. A lubricant supply rail as defined in claim 14, wherein said inlet ports and said transfer bores are spaced along said pipe at distances relative to each other which correspond to the distances between the cylinder head lubricant outlet port and the rocker arm support pedestal lubrication channels.

16. The lubricant supply rail described in claim 10, wherein said bottom wall portion and said arcuate hood portion are integrally molded to form a unitary pipe.

17. A lubricant supply rail for conveying oil from a lubrication outlet port contained in the cylinder head of an internal combustion engine to the internal lubrication circuits of a plurality of rocker arm support pedestals secured to the cylinder head, said lubricant supply rail including a pair of lubricant inlet ports, each spaced equidistantly inwardly from the terminal ends of the rail and a plurality of lubricant transfer bores each of which corresponds to the interal lubrication circuit of a rocker arm support pedestal, the distances between said rocker arm support pedestal lubrication circuits and the distances between the transfer bores being equal so that installation of the rail on the engine cylinder head in engagement with each rocker arm support pedestal with either end of the rail toward the cylinder head outlet port will result in simultaneous automatic fluid alignment between the head outlet port with the rail inlet port and each rocker arm support pedestal lubrication circuit with a rail transfer bore.

18. A lubricant supply rail for providing direct automatic fluid connection between an internal combustion engine lubricant supply having a lubricant outlet port located on the engine cylinder head and the internal lubrication circuit of each of a plurality of rocker arm support pedestals mounted at spaced locations along the cylinder head to transfer lubricant from the outlet port to each pedestal comprising a single unitary longitudinal pipe including a flat bottom wall portion including a pair of lubricant inlet ports positioned equidistant from each end of the pipe, an arcuate hood portion including a plurality of spaced lubricant transfer bores, and a pair of sealing end caps, wherein said flat bottom wall portion engages the cylinder head so that one of said inlet ports aligns with said outlet port and said arcuate hood portion engages each pedestal so that each transfer bore aligns with a pedestal internal lubrication circuit to automatically establish a sealed lubrication circuit from the cylinder head outlet port to each rocker arm support pedestal when the supply rail is installed on the engine.

* * * * *